US006246851B1

(12) United States Patent
Tietze et al.

(10) Patent No.: US 6,246,851 B1
(45) Date of Patent: Jun. 12, 2001

(54) PHOTORECEPTOR DRUM

(76) Inventors: Wolfgang Tietze, Krummer Weg 3, 59581 Lippstadt; Heinrich Weber, Buschweg 13, 59581 Warstein, both of (DE)

( * ) Notice: Subject to any disclaimer, the term of this patent is extended or adjusted under 35 U.S.C. 154(b) by 0 days.

(21) Appl. No.: 09/394,461

(22) Filed: Sep. 11, 1999

(30) Foreign Application Priority Data

Sep. 11, 1998 (DE) ..... 198 41 591

(51) Int. Cl.[7] ..... G03G 15/00

(52) U.S. Cl. ..... 399/159; 399/116; 399/117

(58) Field of Search ..... 399/113, 116, 399/117, 159, 167; 430/56, 69

(56) References Cited

U.S. PATENT DOCUMENTS 3,985,432 * 10/1976 Hou et al. ..... 399/117
5,130,751 * 7/1992 Sato et al. ..... 399/117
5,570,160 * 10/1996 Miwa et al. ..... 399/159
5,952,141 * 9/1999 Ohno et al. ..... 430/69

* cited by examiner

*Primary Examiner*—Sophia S. Chen
*Assistant Examiner*—Hoang Ngu
(74) *Attorney, Agent, or Firm*—N Paul Friederichs; Angenehm Law Firm

(57) ABSTRACT

Photo conductor drum comprised of a drum body with an outer cylindrical surface, a flange attached to the drum body at the front side with a snug fit and a centric axis of rotation for the drum body, which in a coaxial way feeds through the drum body and flange and can be connected with the flange, characterized by the indented axle part (13,33) which is connected with the flange (12) without radial free space.

19 Claims, 8 Drawing Sheets

PHOTORECEPTOR DRUM

FIELD OF THE INVENTION

The invention at hand concerns a photo conductor drum comprised of a drum body with an outer cylindrical surface, a flange attached to the drum body at the front side with a snug fit and a centric axis of rotation for the drum body, which coaxially feeds through the drum body and flange and can be connected with the flange.

BACKGROUND OF THE INVENTION

A photo conductor drum of the above mentioned kind is known, for example, from the EP 0 629 927 A2. In this known photo conductor drum the flange is oversized in regard to the inner diameter of the drum body and the connection of flange and drum body is achieved by the shrinking of the flange in low temperature and ensuing insertion in the drum body. It is generally known that these photo conductor drums require an extreme centric running precision of the cylindrical surface of the photo conductor drum. Therefore, an adjustment is carried out on the photo conductor drum referred to in the above-mentioned paper. In this procedure, a collar sitting on the axle which is the axis of rotation of the drum body, is inserted in the flange. However, there is free space between the inside of the flange and the collar so that an adjustment with setting screws (which have a radial effect), can be made afterwards to achieve the necessary centric running precision. This kind of adjustment is time consuming and also inaccurate. The radial end position of the setting screws can not be adjusted with the necessary accuracy of measurement because most of the time the setting screws are made of a harder material than the collar. Inaccuracies will already occur in the process of screwing it on. In addition to that, deformation and abrasion of the setting screws will lead to inaccuracies in the course of time.

The task of the invention at hand is therefore, to create a photo conductor drum of the above mentioned kind which already demonstrates the necessary centric running precision after the production and assembling of the particular modules to a photo conductor drum without extensive adjustments.

SUMMARY OF THE INVENTION

The solution to this task delivers an invention based photo conductor drum of the above-mentioned kind with the characteristic features of the main claim. According to the invention, an axle part is intended which is connected to the flange without radial free space. This axle part replaces the collar that has been used until now which had free space to the inside of the flange. The previously required setting screws are no longer necessary.

A variation of the invention is, for example, a solution where the axle part is cast into the centric area in the flange. But according to another alternative solution, the axle part as well can be fastened tightly in a centric area of the flange and could be connected to it with screws or a similar device.

A preferred advancement of the invention intends that the axle part shows a part of a ring which is located on the inside of the flange and is connected to it with screws or a similar device. Furthermore it is preferably intended, that the axle part outside the flange has an area with a smaller diameter which serves as a mount for a ball bearing.

Within the connecting area between the drum body and flange it could be advantageous if the drum body is coated with an anodic material of, for example, several mm to make the assembling easier. This results in a greater ability to glide. At the same time a low transitional resistance will be maintained.

Generally, the invention based photo conductor drum shows two opposite flanges that are connected by a centric axle and this axle centrally feeds through the axle part. There are various possibilities to fasten the two opposite flanges of the drum body against each other in an axial direction. One variation of the invention calls for the use of pull anchors.

Preferably, the flanges, within the scope of its invention, consist of aluminum and the axle parts are made of steel.

Another preferred advancement of the invention shows that the snug fit between flange and drum body in axial direction extends only over a part of the strength of the flange material. This has the advantage, that the drum body and the flange can be handled easier during the treatment prior to their assembling. If it comes to minor damages of the drum body or the flange, they can not be permitted to occur in the area of the snug fit, or this would result in inaccuracies in the snug fit which could have an effect on the centric running precision of the drum body. Damages on the other hand, which occur outside of the intended snug fit, are harmless. In this variation of the invention it is therefore possible, to take hold of the drum body or flange outside of the snug fit with gripping devices without impairment of the snug fit. An advancement in this scope of the invention shows that the outside area of the flange has a radial overhanging collar which has a larger diameter than the flange in the area of the snug fit and the drum body in its axial outer area shows a thread on the inside, through which an outer ring bar of the drum body is formed which overlaps the collar of the flange and aligns with it on the outside. It is also preferred, that the thread of the drum body is measured in a way that a free space remains between the ring bar of the drum body and the collar of the flange. That way there is no snug fit in this area. The snug fit is preferably located in axial direction further inside.

Furthermore the fitting process between flange and drum body can preferably be eased by applying a cone or a bevel on the inside of the flange and/or applying a cone or a bevel on the outside of the snug fit on the cylindrical inside of the drum body which is facing the flange.

A preferred advancement of the invention is that the drum body, from the view of the snug fit on the inside, shows an auxiliary thread or a ring groove. This auxiliary thread or ring groove can be used for an axial connection between the drum body and the flange, by using a cramp or similar device for example, which will be taken in this auxiliary thread or ring groove and by than connecting this cramp with the flange using a screw connection or similar device which will fix the flange axially. Naturally there are other mounting variations for which auxiliary thread could be of use as well.

Another preferred advancement of the invention also shows that the drum body and/or the flange and/or the ball bearing fit is rotated in a clamping device during the production of the photo conductor drum. This provides a high accuracy in measurement and makes an accurate coordination of the parts relative to each other possible and is therefore of advantage also in connection with the other mentioned characteristics for the achievement of the high centric running precision in regard to the outer cylindrical diameter area of the photo conductor drum.

Following is a more detailed description of the invention at hand using preferred embodiments with reference to the attached drawings.

DETAILED DESCRIPTION OF THE FIGURES

Figure 1:
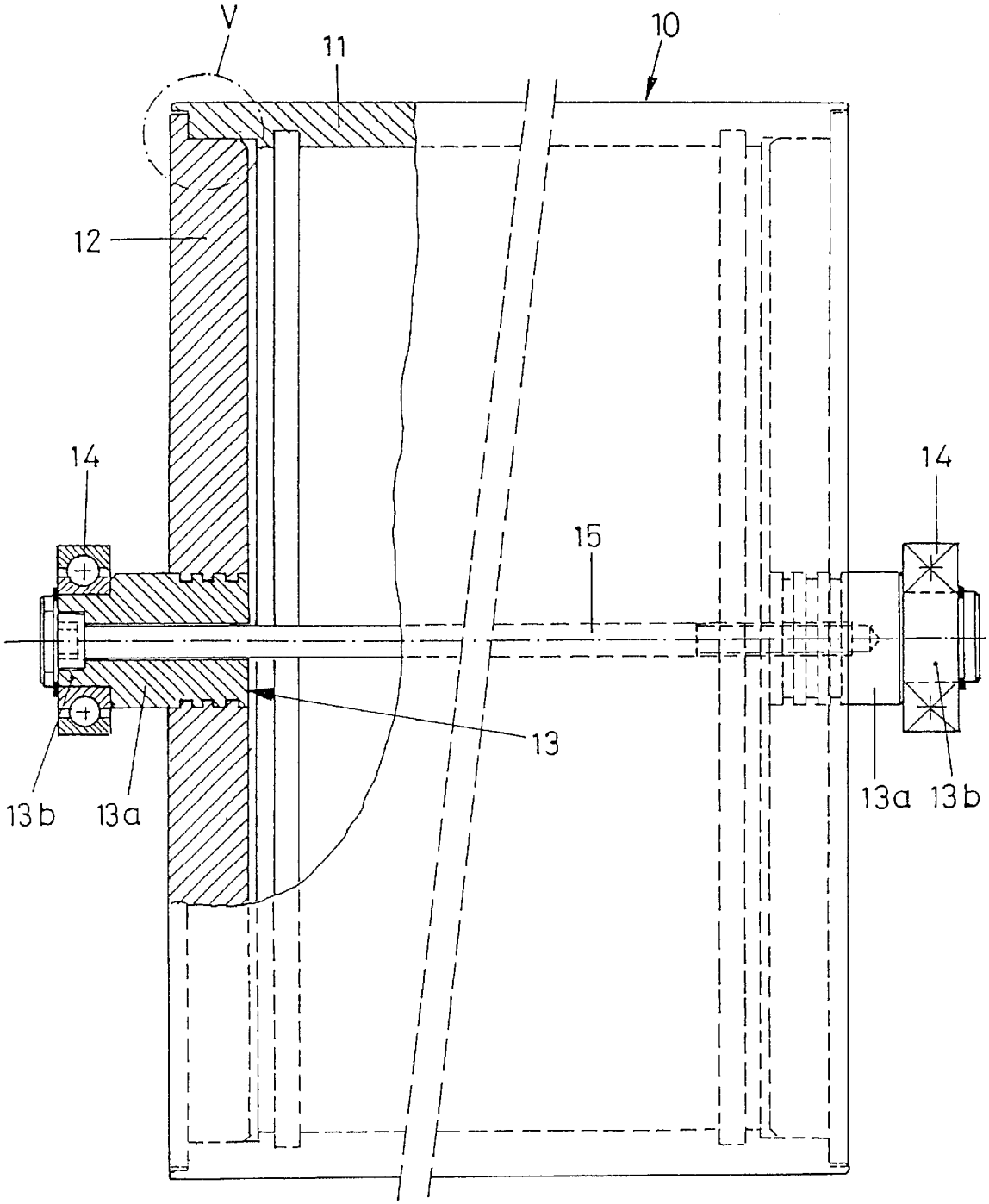
FIG. 1 is a longitudinal cross-section of a photo conductor drum based on the invention according to an execution variation of the invention.

The first reference will be made to FIG. 1. FIG. 1 shows a first variation of an invention based photo conductor drum 10, which contains a drum body 11, which is basically cylindrical and which will later, for the purpose of its function, be coated with a photo conducting material. The flange 12 , which could be made of aluminum for example, will be inserted with a snug fit on the front side of this cylindrical drum body 11.

In the cylindrical area, in the execution variation according to FIG. 1, a cylindrical axle part 13 will be preferably cast in the flange 12 and this axle part 13 is formed like an axle stub and preferably made of steel. The axle part 13 is, as one can see, only partially cast in flange 12 and another part 13*a* sticks out of flange 12 in axial direction and is arranged to the outside, meaning, away from the inside of the drum body 11. Following this part 13*a* the axle part 13 shows a ring section with a smaller diameter which serves as ball bearing mount 13*b* for the ball bearing 14. On the other side of the drum body 11, an axle part 13, just like that is intended with an identical ball bearing mount 13*b* for the ball bearings 14 and the two ball bearing 14 form the pivot bearing for the drum 10. Both axle parts 13 centrally take in a pull anchor 15 which extends through the complete drum body and connects both axle parts 13, and therefore, both flanges 12 with each other as well. This pull anchor 15 receives mainly traction power and prevents movement of the flanges 12 in axial direction against the drum body. Pull anchor 15 and axle parts 13 basically form the axle of the drum body 11. The more precise design of the snug fit between flange 12 and drum body 11 will now be explained in reference to FIG. 5.

Figure 5:
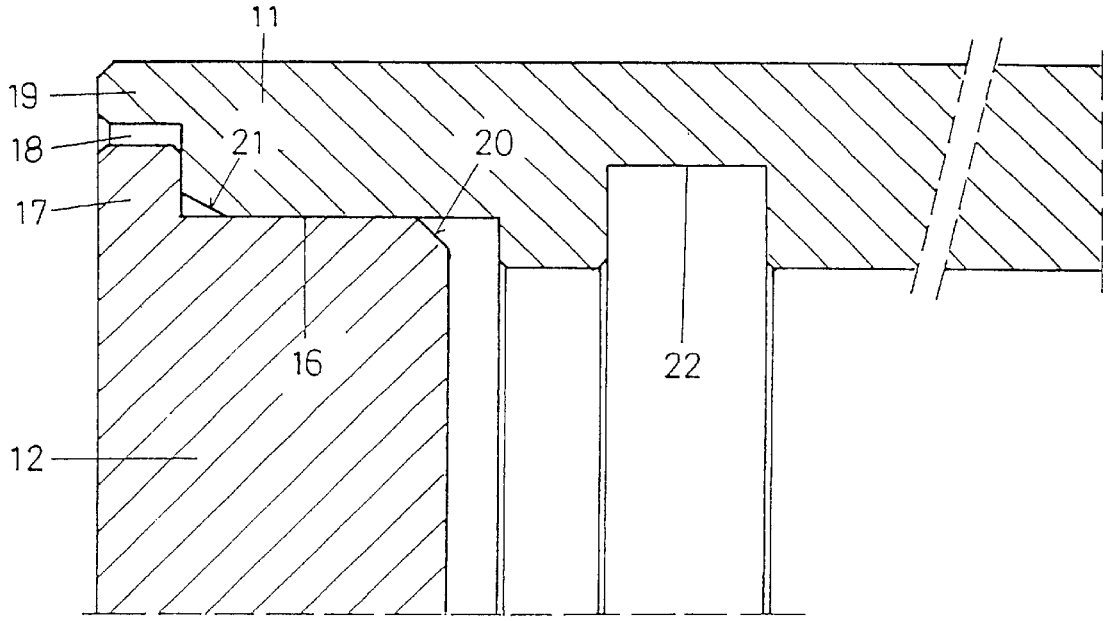
FIG. 5 is an enlarged partial cross-section of a photo conductor drum according to detail V of FIG. 1.

FIG. 5 shows an enlarged section of the connecting area between drum body 11 and flange 12. The snug fit 16 can be seen and the fit between flange 12 and drum body 11 in the inner area of the flange extends across the predominant portion of the material thickness of flange 12 and, therefore, also the joint with the drum body 11. But it is also visible, that the flange 12 in the outer area shows a collar 17 which has a larger diameter than flange 12 in the area of the snug fit 16.

Corresponding to this collar 17, the drum body 11 has in its outer area a thread 18 through which generates the outer ring bar 19 of the drum body 11, which overlaps the collar 17 of the flange 12 and aligns with it on the outside. It can be seen, that the thread 18 is structured in a way that a free space remains between ring bar 19 and collar 17 of the flange, so there is no snug fit in this area. This has essential advantages for the handling during the production procedure of the photo conductor drum. It is possible, for example, that in this area of the inside of ring bar 19, the outside of collar 17 respectively, which in assembled condition of drum 10 have a space between each other (free space 18), the drum body 11 or the flange 12 can be taken hold of with a gripping device. There is no problem if it comes to minor damages in this area. The area of snug fit 16 is protected because of the outer handling area for flange 12 and drum body 11. Therefore, the dimensions of drum body 11 and flange 12 can be precisely matched in the area of snug fit 16. The result of this precise cylindrical snug fit is, that drum body 11 and flange 12 are self-fixed after the assembling.

In addition, the fitting process between drum body 11 and flange 12 is simplified, that in extension of the cylindrical snug fit 16 on the one hand a cone 20 which can be seen on the interior of flange 12 and a similar cone 21 on the exterior of snug fit 16 is formed which is connected to/affiliated with the flange 12 sympathetic/coordinating cylindrical inner surface of drum body 11.

The drum body 11 also has, as seen in FIG. 1 and 5, located further inside a helper screw-in portion 22 or ring groove, which is indented for assembly purposes as explained below with reference to FIG. 2.

Figure 2:
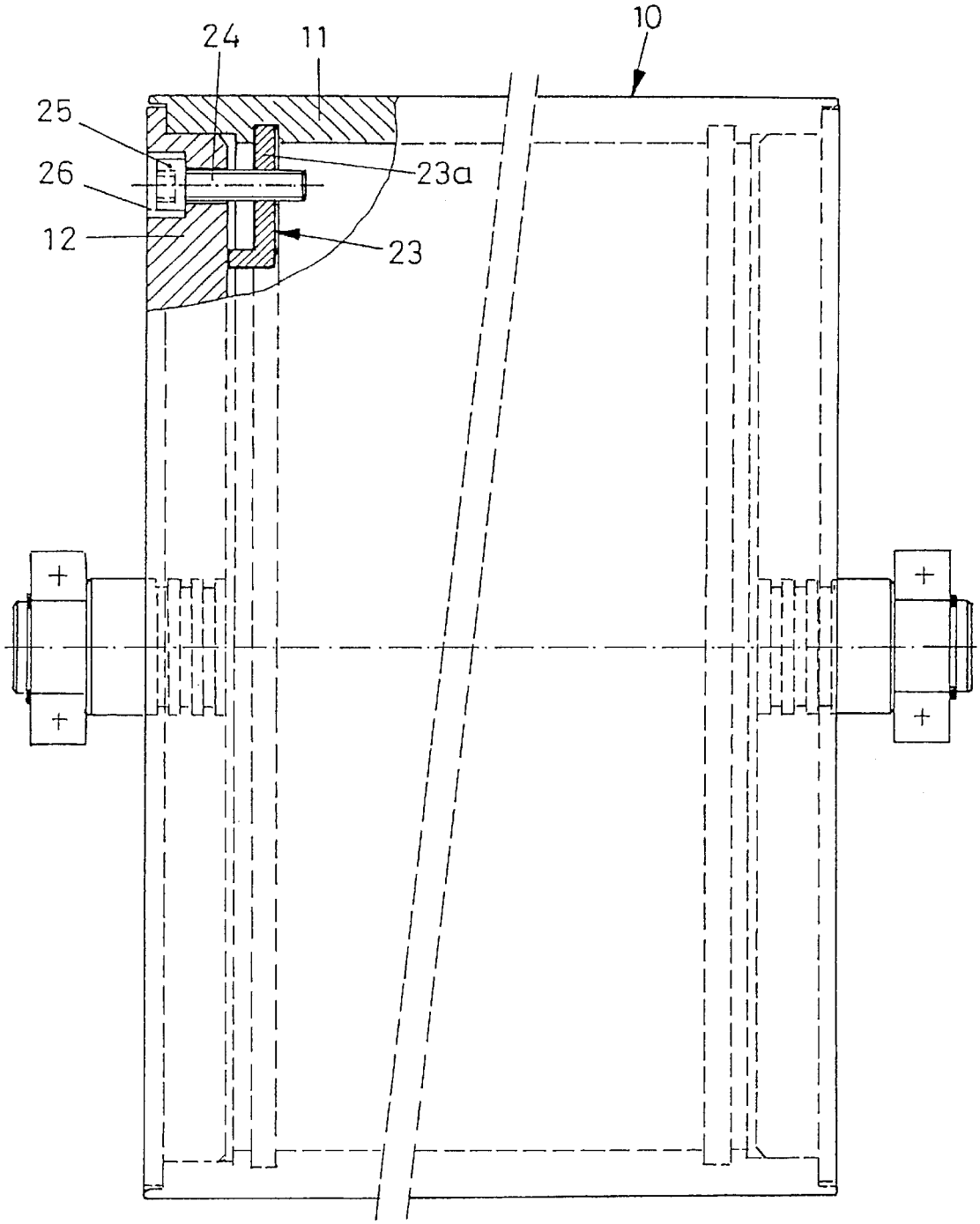
FIG. 2 is a longitudinal cross-section of a photo conductor drum according to a variation of the invention.

FIG. 2 shows a photo conductor drum according to an alternative variation of the invention at hand.

It can be seen, that in this case the mount of flange 12 to the drum body 11 is different from the previously explained embodiment according to FIG. 1. An angular clamp 23 is used which is connected to the flange 12 with screws 24 or similar mounting devices. FIG. 2 shows that the head 25 of the screw 24 lays in an indentation 26 of the flange 12. The clamp 23 is formed angular, showing a reversed L shape in the illustration and the longer leg 23*a* is radially formed, meaning that it also runs parallel to flange 12 and this radial leg 23*a* at the end fits into the ring groove 22 of the drum body 11 and that way establishes the connection between drum body 11 and flange 12.

Figure 3:
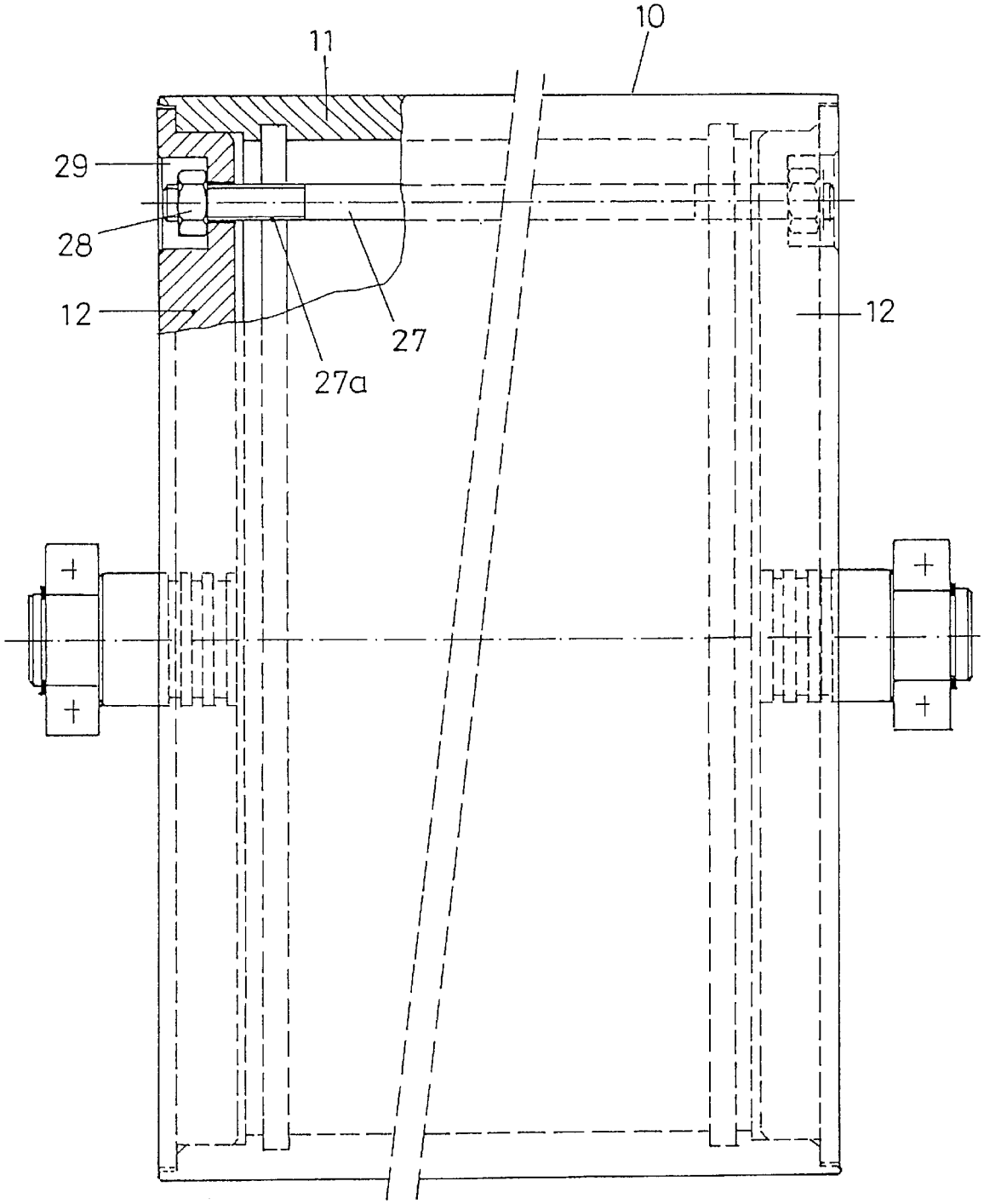
FIG. 3 is a longitudinal cross-section of a photo conductor drum according to another variation of the invention.

In the embodiment according to FIG. 3 the connection between flange 12 and drum body 11 is again formed differently. In this case, pull anchors 27 are intended, each of them showing threads 27*a* at the end. Nuts 28 are screwed on these threads 27*a*, which take in the indentations 29 of flange 12, and the two opposite located flanges 12 will be fit in this way in axial direction against each other.

Figure 4:
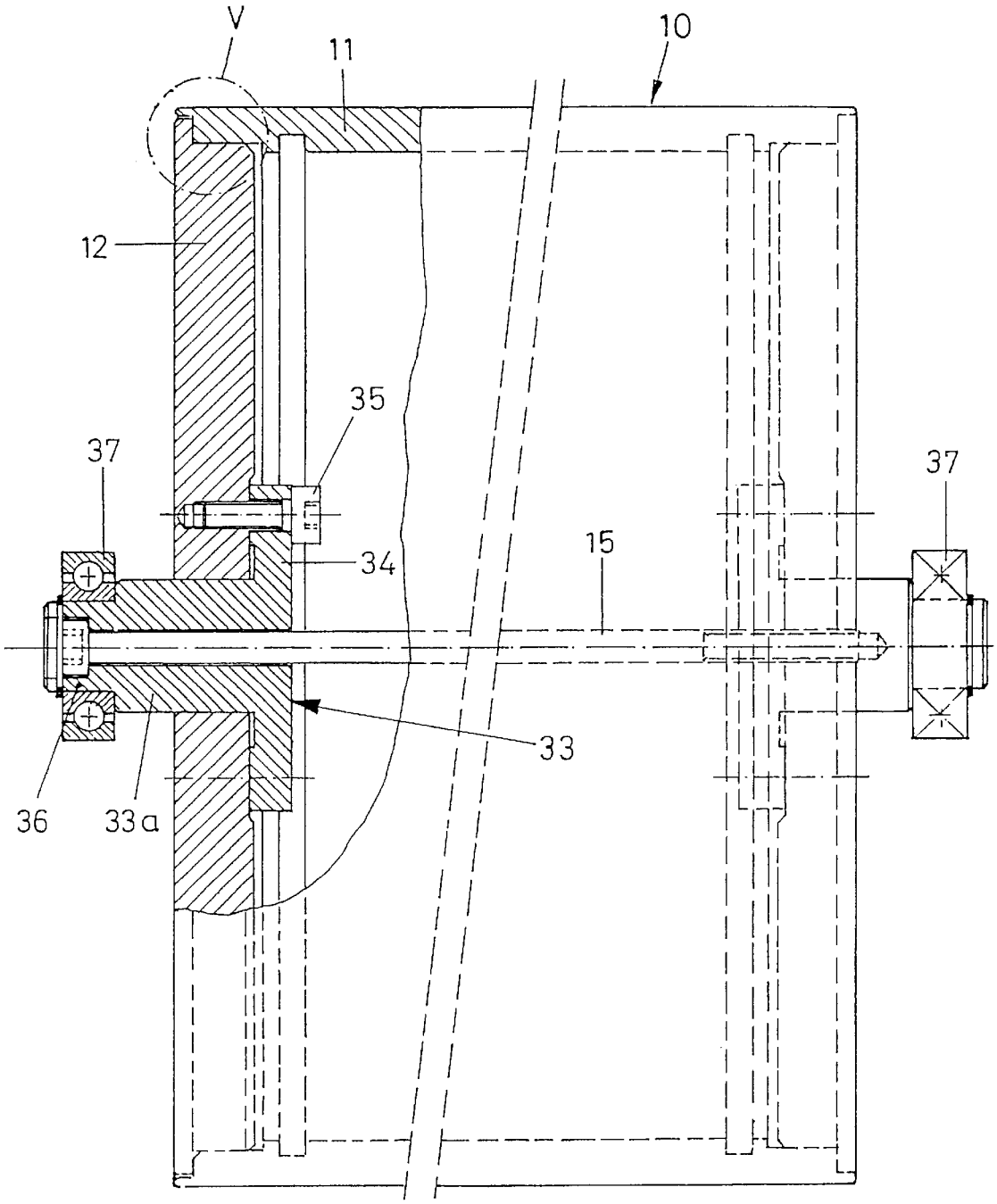
FIG. 4 is a longitudinal cross-section of a photo conductor drum according to another variation of the invention.

FIG. 4 shows a further embodiment of the invention. In this case, the connection between flange 12 and drum body 11 is again solved slightly different. An axle part 33 is intended, similar to FIG. 1 where the axle part 13 was intended, but according to the variation in FIG. 4, the axle part 33 has a different form, for this axle part 33 has a ring flange 34 which lays on the inside of flange 12 against it. The axle part is screwed to the flange 12 over the ring flange 34 by the use of fitting screws 35. The axial lock for the two opposite flanges 12 with each other is carried out similar to FIG. 1 with a pull anchor 15 for which the pull anchor centrally feeds through the axle part 33 on both sides.

On the outside, connected to the cylindrical 33*a* of the axle part, is an area 36 of the axle part, which has a smaller diameter. This area 36 has the function of a ball bearing mount for the ball bearing 37. Both sides of the photo conductor drum 10 have these ball bearings 37 for their pivot bearing.

It is important, in the scope of the invention at hand, that an extreme centric running precision must be achieved for the outer diameter area of the drum body 11, because the photo conductor drum 10, in the scope of the invention, will be preferably used in copiers or printers. These high requirements on the centric running precision can be achieved, according to the invention, without a later adjustment by, among other things, rotating the drum body 11 and the flange 12, which are connected by the snug fit 16 (see FIG. 5), in a clamping device during the process of production. In the variation according to FIG. 4, the flange 12 is connected to the drum body 11 by fitting and the axle part 33 which is centrally taken in by the flange 12, is also connected with flange 12 by fitting. That also means, that a rigid connection without gap in the fitting area exists between flange 12 and axle part 33.

Figure 6:
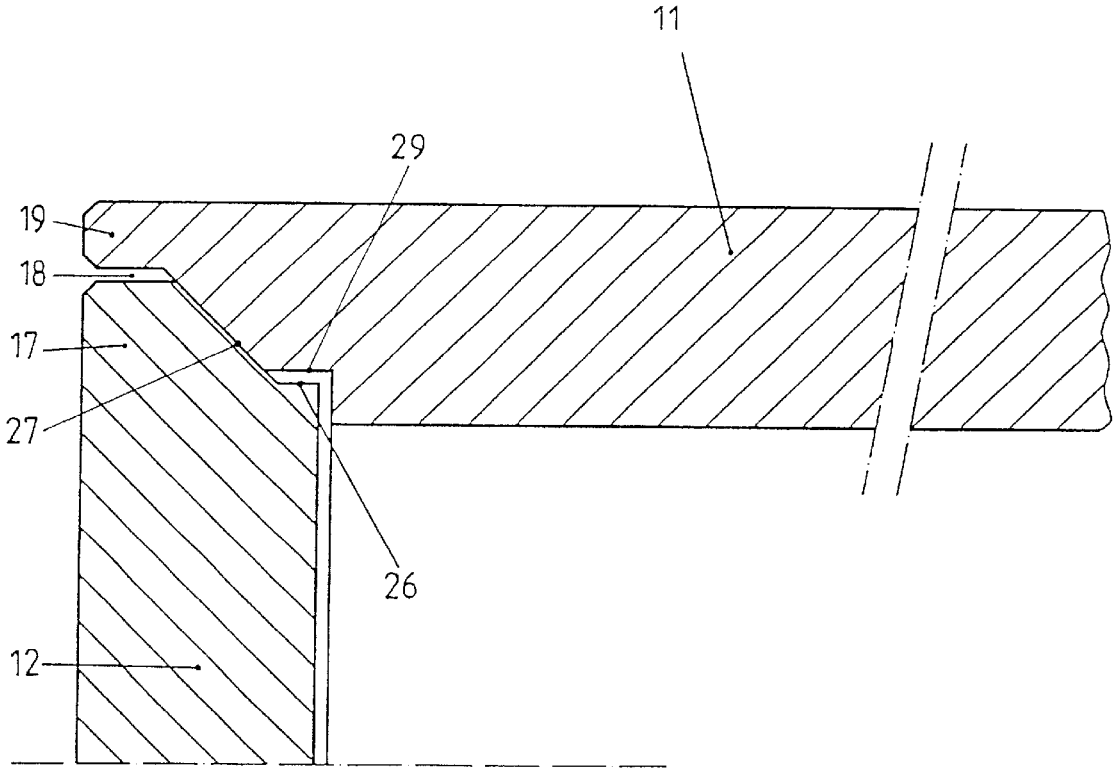
FIG. 6 is an enlarged cross-section of a photo conductor drum according to a variation of the invention.

Following, reference is made to FIG. 6 which shows a detailed view of the fitting area between drum body 11 and flange 12. In this alternative variation of the invention, a cylindrical area 26 is intended in the inner area, which extends over a part of the material thickness of flange 12 and a cylindrical area 29 of the drum body exists, respectively and these cylindrical areas 26 and 29 are formed as loose auxiliary fittings to each other. On the outer area of the drum body 11 and the flange 12, just as described in FIG. 5, a ring bar 19 can have a clearance from the outside of collar 17, so that the free space 18 lays in between. The design of flange 12 and drum body 11 in the outer fringe area is also similar to the embodiment according to FIG. 5 with the described advantages therein.

Figure 7:
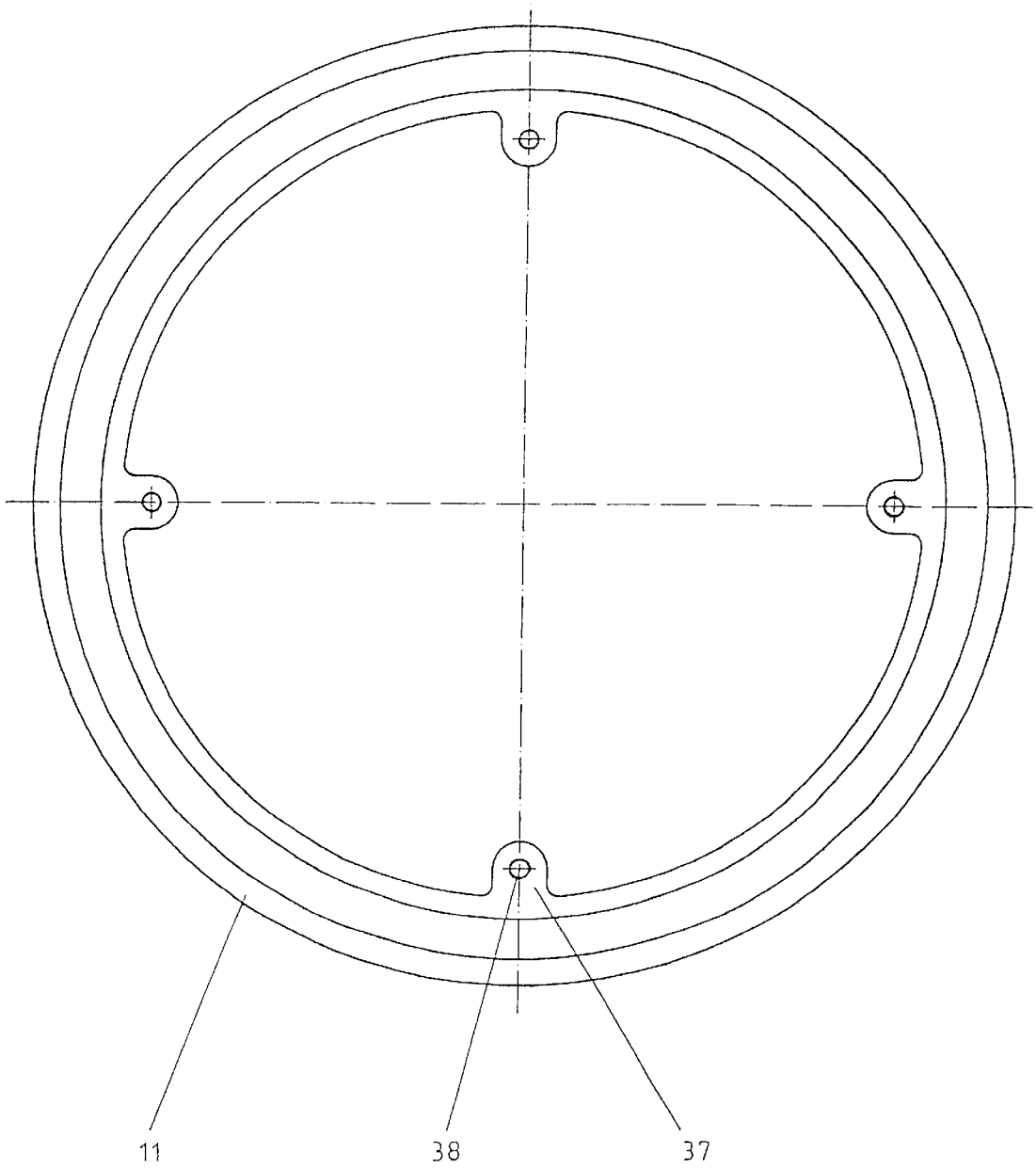
FIG. 7 is a front view of a photo conductor drum according to a variation of the invention.

FIG. 7 shows an embodiment according to another variation of the invention. The view shown is from the front side on the drum body 11 which, for example, can consist of an aluminum profile and in this variation according to FIG. 7 shows several inside positioned ribs 37, which are radially extending across the diameter with space between them. These inner ribs 37 can have threaded holes (38) which can hold screws for the fixing of flange 12 on drum body 11. The drum body can consist of an extruding pipe, which on the inside has the ribs illustrated in FIG. 7.

Figure 8:
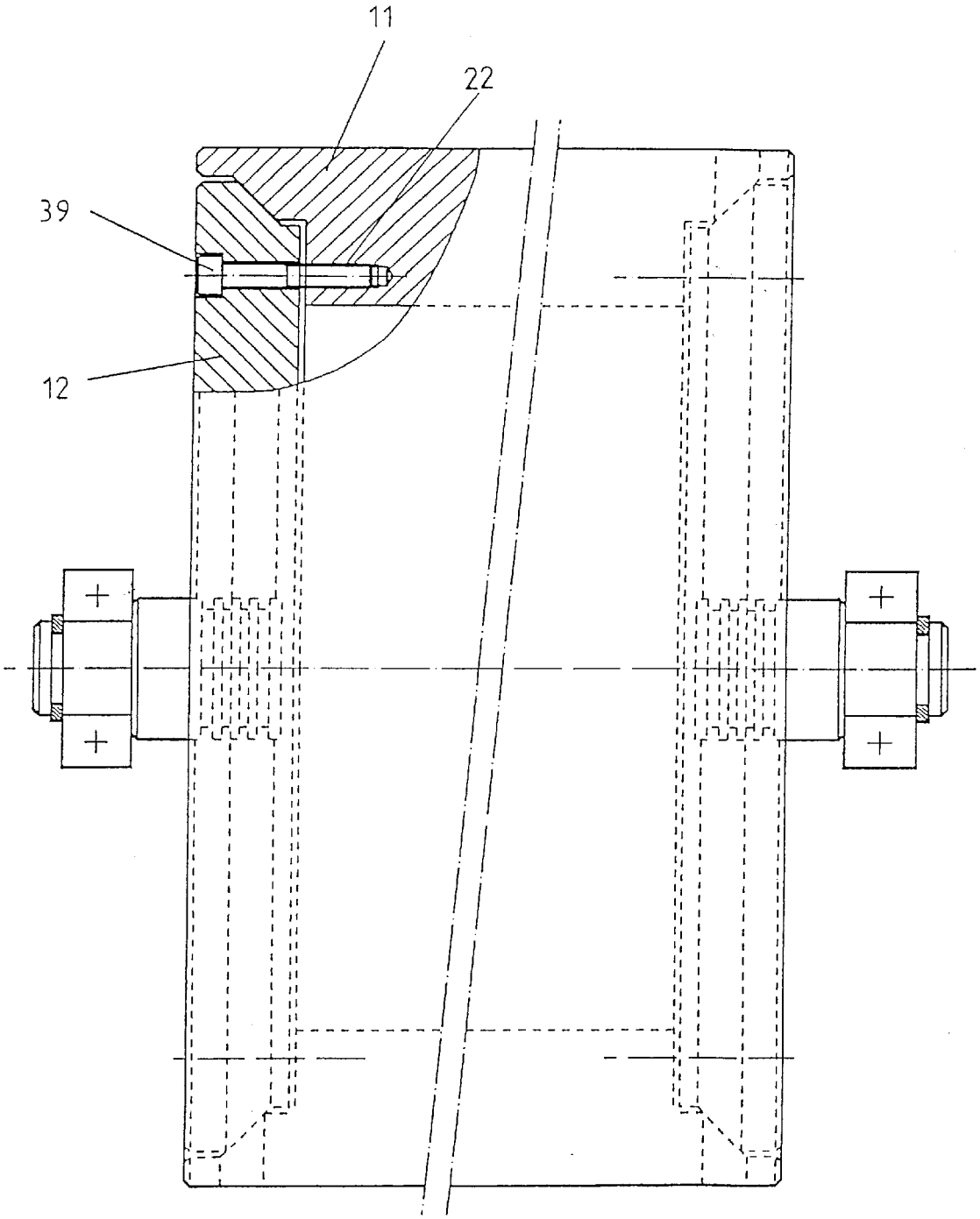
FIG. 8 is a side view of a photo conductor drum according to a variation of the invention with partial cut-out.

FIG. 8 shows a photo conductor drum according to a variation of the invention in which each flange 12 independently from the flange on the other side is nonpositive separably connected with the drum body 11 using the in FIG. 8 illustrated screws 39, which can be fixed in axial direction in relation to the drum body 11 with the drill holes 22 in the drum body, to fasten the flange this way.

What is claimed is:

1. Photo conductor drum comprising:

a drum body, the drum body having an outer cylindrical surface;

a centric axle for rotation for the drum body;

a flange attached to the drum body with a snug fit and connected with the concentric axle; and an indented axle part (13,33) connected with the flange (12) without radial free space, the axle part (13) is positioned in a centric area into the flange (12).

2. The photo conductor drum according to claim 1 further comprising:

a ring (34) fastened on the inside of the flange (12).

3. The photo conductor drum according to claim 1 wherein the axle part (33) outside the flange (12) has an area (36) with a smaller diameter which serves as mount for a ball bearing (37).

4. The photo conductor drum according to claim 1 further comprising:

a second flange opposite the first flange, the two flanges (12) are connected by the centric axle (15) that centrally feeds through the axle part (33).

5. The photo conductor drum according to claim 1 further comprising:

a second flange opposite the first flange, the two flanges (12) are fixed in axial direction against each other with pull anchors (27).

6. The photo conductor drum according to claim 1 wherein the flange is made of aluminum and the axle part (13) is made of steel.

7. The photo conductor drum according to claim 1 wherein the snug fit (16) between flange (12) and drum body (11) extends only over a part of the of the flange (12).

8. The photo conductor drum according to claim 1 wherein the flange (12) has a radial overhanging collar (17).

9. The photo conductor drum according to claim 1 wherein the drum body (11) further comprises:

a thread (18);

an outer ring bar (19) is adjacent the thread, the ring bar overlaps and aligns with a collar (17) of the flange (12).

10. The photo conductor drum according to claim 1 further comprising:

a collar of the flange;

a ring bar (19) of the drum body;

a thread (18) on the inside of the drum body (11), the thread is positioned to provide a free space between the ring bar (19) of the drum body (11) and the collar (17) of the flange (12).

11. The photo conductor drum according to claim 1 further comprising:

a bevel on the inside of the flange (12) and a corresponding bevel on a cylindrical inside of the drum body (11).

12. The photo conductor drum according to claim 1 wherein the drum body (11) defines a ring groove (22) on the inside.

13. The photo conductor drum according to claim 1 wherein a ring groove (22) receives a clamp (23) which is axially connected to the flange (12).

14. The photo conductor drum according to claim 1 wherein an outside diameter and the snug fit (16) of the drum body (11) and a ball bearing fit **(13*b*,36) of the flange (12)** are rotated in a clamping device.

15. The photo conductor drum according to claim 1 wherein the flange (12) has an outer cone extending over at least a part of the flange (12) and centering the flange (12) in the middle of the drum body (11), and the drum body (11) on at least one end has a corresponding inner cone related to the outer cone (27) the inner cone extends at least over a part of a connection area with the flange (12).

16. The photo conductor drum according to claim 1 further comprising:

a cylindrical area (26) of the flange (12); and a cylindrical area (29) of the drum body (11), the cylindrical areas (26) and (29) are formed as loose auxiliary fittings of each other.

17. The photo conductor drum according to claim 1 wherein the drum body (11) is made of aluminum and has a plurality of inside positioned ribs (37).

18. The photo conductor drum according to claim 17 wherein the inside positioned ribs (37) define threaded holes (38).

19. The photo conductor drum according to claim 1 further comprising:

at least one additional flange, each flange (12) is separably connected with the drum body (11).

* * * * *